US009847597B2

(12) United States Patent
Uttarkar et al.

(10) Patent No.: US 9,847,597 B2
(45) Date of Patent: Dec. 19, 2017

(54) ELECTRICAL CONNECTOR WITH SEALING STRUCTURE

(71) Applicant: MOLEX INCORPORATED, Lisle, IL (US)

(72) Inventors: Vinay Uttarkar, Bangalore (IN); Prasanth Krishnan, Bangalore (IN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/025,948

(22) PCT Filed: Oct. 3, 2013

(86) PCT No.: PCT/IN2013/000603

§ 371 (c)(1),
(2) Date: Mar. 30, 2016

(87) PCT Pub. No.: WO2015/049691

PCT Pub. Date: Apr. 9, 2015

(65) Prior Publication Data

US 2016/0240959 A1 Aug. 18, 2016

(51) Int. Cl.

| | |
|---|---|
| ***H01R 13/52*** | (2006.01) |
| ***H01R 13/627*** | (2006.01) |
| *H01R 13/422* | (2006.01) |

(52) U.S. Cl.

CPC ..... *H01R 13/5219* (2013.01); *H01R 13/5205* (2013.01); *H01R 13/6272* (2013.01); *H01R 13/4223* (2013.01)

(58) Field of Classification Search

CPC ..... H01R 13/5202; H01R 13/5205; H01R 13/5219; H01R 13/5221; H01R 33/965

USPC ..... 439/271

See application file for complete search history.

(56) References Cited

U.S. PATENT DOCUMENTS

| | | | | |
|---|---|---|---|---|
| 5,597,324 | A | 1/1997 | Katsunori | |
| 6,254,431 | B1 | 7/2001 | Murakami et al. | |
| 6,332,800 | B2 | 12/2001 | Kodama | |
| 6,783,381 | B2 | 8/2004 | Fukuda | |
| 7,097,483 | B2 | 8/2006 | Hayashi | |
| 7,611,369 | B2 | 11/2009 | Matsunaga | |
| 2010/0317227 | A1 | 12/2010 | Bouchan et al. | |
| 2014/0113474 | A1* | 4/2014 | Eckel | H01R 13/506 439/271 |

* cited by examiner

*Primary Examiner* — Phuong Dinh
(74) *Attorney, Agent, or Firm* — Clarence R. Moon

(57) ABSTRACT

An electrical connector system includes a plug connector and a receptacle connector each of which having a plurality of terminal receiving cavities for receiving a plurality of terminal lead wires. The plug connector having a perimeter seal for creating a waterproof barrier between the plug connector and the receptacle connector. The receptacle connector including at least one bridging portion having a surface for guiding and aligning the seal when the plug and receptacle connectors are mated together.

15 Claims, 7 Drawing Sheets

ELECTRICAL CONNECTOR WITH SEALING STRUCTURE

RELATED APPLICATIONS

No claim of priority is made at this time.

FIELD OF THE INVENTION

The present invention relates to the field of electrical connectors. In particular, sealed and unsealed electrical connectors used in a wire to wire cable harness.

DESCRIPTION OF RELATED ART

Electrical connectors that are exposed to harsh environmental conditions require a sealing structure for preventing infiltration of liquid and or moisture and debris. Typically this is accomplished by providing an electrical connector assembly that includes an interface seal and wire seal.

The interface seal is generally placed at the mating end of a first receptacle and upon complete mating with a second cooperating plug form a tight seal between the connectors that prevent the contamination of the electrical connector from liquid and or moisture and debris. The wire seal portion of the sealed connector system comprises either a matt seal or a grommet positioned at the wire entry portion of each connector.

The interface or peripheral seal comprises a cross section that includes a flat surface and an irregular sealing surface. The flat surface adjacent a corresponding flat portion of a connector housing and typically held in place by a seal retainer that maintains the position of the seal not allowing it to be displaced. The peripheral seal is retained in its position in the housing by surface tension. The irregular portion of the seal making contact with a corresponding surface of a second connector upon engagement of the first and second connectors. The seal being resiliently compressed, providing a barrier to prevent contamination of the electrical connector from liquid and or moisture and debris at the mating interface of the connector system.

This type of sealing structure has several drawbacks, namely, the requirement of an additional structure to maintain the interface seal in position or an additional operation needs to be incorporated for positioning the interface seal after every unmating. Additionally, many other applications do not require a sealed connector system, in such cases, a different plug and receptacle has to be used/designed; simply stated, it is difficult to use the existing connector system by removing the sealing structure and still provide an operable connector system.

BRIEF SUMMARY

A connector system is provided that is used for connecting a wire harness. The connector system includes a first receptacle connector and a second plug connector for complete mechanical and electrical connection. The connector system includes a plurality of electrically conductive terminals retained in each respective connector.

The connector is configured to be used in either a sealed or unsealed version. Each connector includes a wire seal or grommet secured to a terminated lead wire that is inserted to an accommodating cavity or chamber in a respective one of the connectors for the prevention of liquid and or moisture and debris from entering the connector through the wire accommodating portion of each connector.

A perimeter or interface seal is also provided at the connecting interface between the plug connector and the receptacle connector. The perimeter seal is positioned on one of the connectors and, upon connecting of the receptacle connector with the plug connector, a portion of the second connector overlaps the seal, creating a barrier preventing liquid and or moisture and debris from entering the connector through the interface portion of the connector system.

Further, a seal locating or positioning structure is provided on one of the connectors for positioning the perimeter seal placed on the first connector. The seal locating structure maintains and secures the seal in place after the plug connector and receptacle connector are fully engaged.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
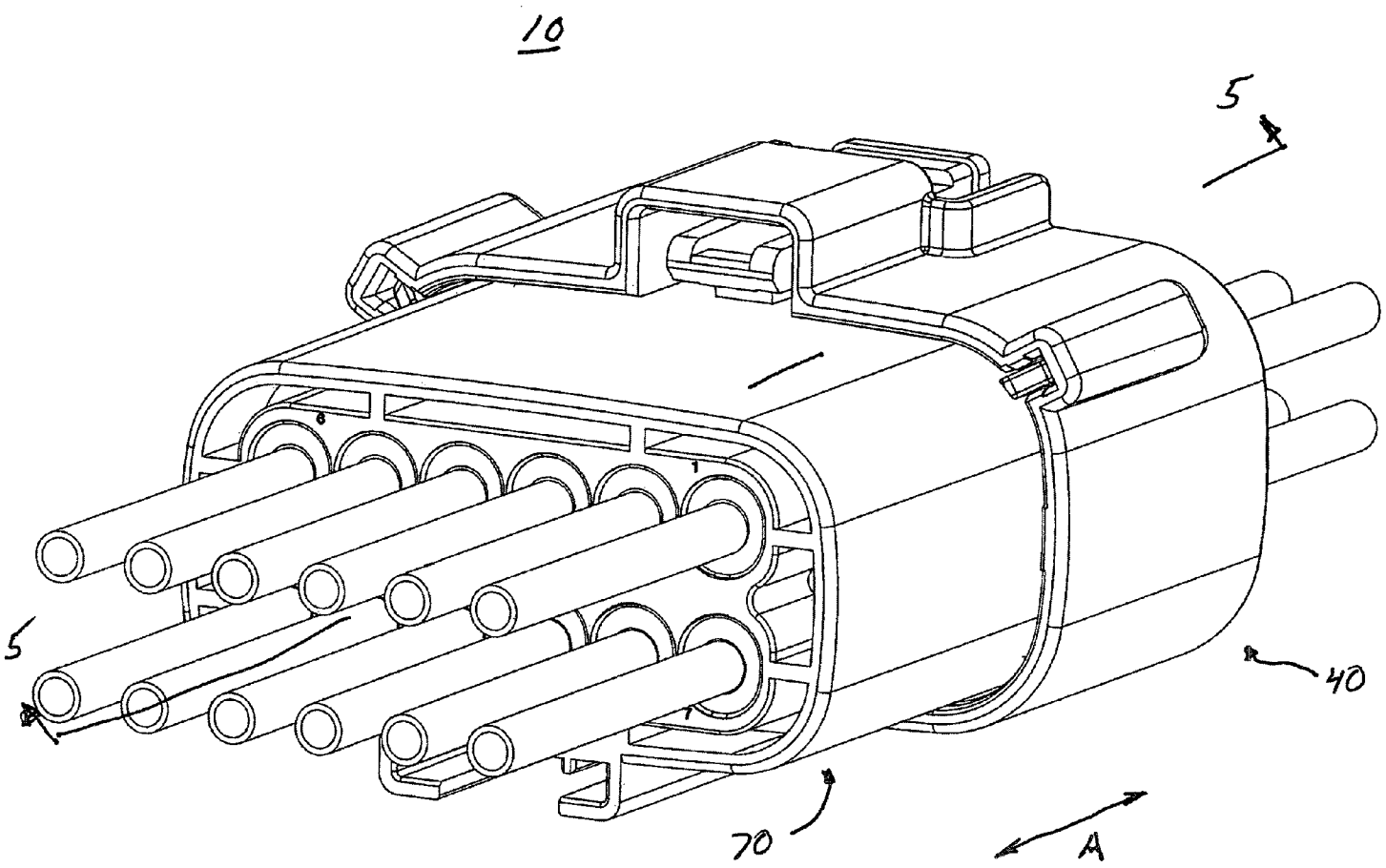
FIG. 1 is a perspective view of the connector system according to one embodiment of the present invention.
Figure 2:
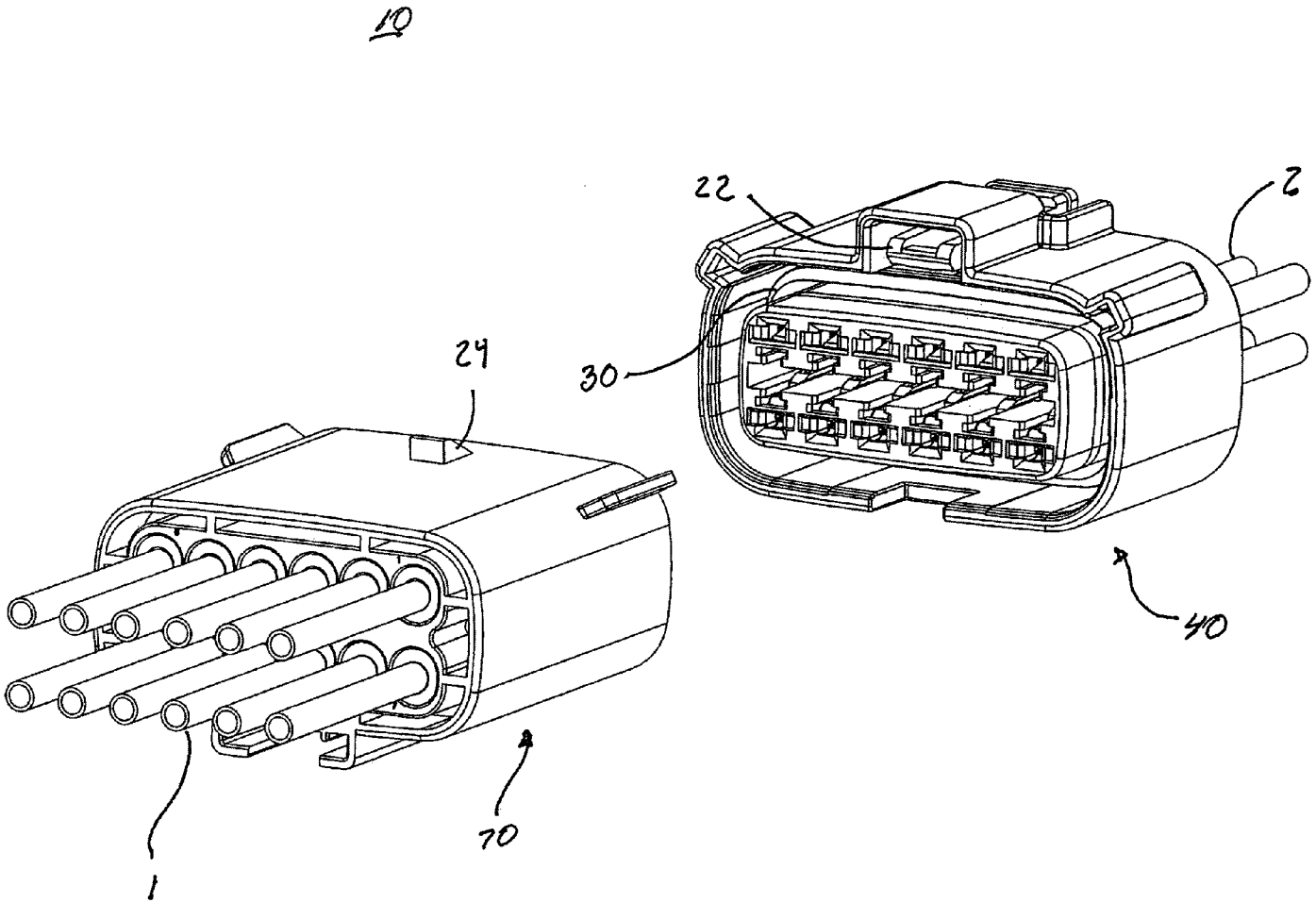
FIG. 2 is a perspective view of the connector system of FIG. 1 with the plug connector separated from the receptacle connector.

The detailed description that follows describes exemplary embodiments and is not intended to be limited to the expressly disclosed combination(s). Therefore, unless otherwise noted, features disclosed herein may be combined to form additional variations that were not otherwise shown for purposes of brevity.

While the preferred embodiment of the invention have been shown and described, it will be apparent to those skilled in the art that changes and modifications may be made therein without departing from the spirit of the invention, the scope of which is defined by the appended claims. Like members are designated by like reference characters.

In one embodiment of the present invention, and in the accompanying figures, a wire to wire connector system (10) is shown and includes a first connector, typically a receptacle type connector (40) and a second connector typically a plug type connector (70) mateable along a direction (A). Each connector has a plurality of cavities molded into their main body portions that receive a plurality of male (1) and female (11) electrically conductive terminal leads. A locking structure (20) (not shown in the drawing) that includes a resiliently deflecting locking member (22) formed on one of the first connector (40) and is selectively engageable with a locking projection (24) formed on the second connector (70) for securing the connectors together when fully coupled. In other embodiment, the resiliently deflecting locking member (22) may be formed on one of the second connector (70) and the locking projection (24) may be formed on one of the first connector (40). Additionally, an elastomeric peripheral/interface seal (30) can be positioned on one of the first connector (40) to prevent the passage of liquid and or moisture and debris to the interior of the connectors through mating interface, which can prevent proper electrical connection between the electrical terminals (2, 12).

As best illustrated in FIGS. 1-4, the connector system (10) includes a first receptacle connector (40) and a second plug connector (70). The receptacle connector (40) includes a receptacle housing (42) molded from an electrical insulative material and includes a main body portion (50), a front or mating portion/face (52) extending from one side of the main body portion (50) and a rear portion or terminal receiving portion (54) extending from an opposite side of the main body portion (50). The main body portion (50) includes a plurality of cavities or passages (60) (not shown in the drawing) formed therein for receiving a plurality of first electrically conductive terminals (12). The first electrically conductive terminals (12) are inserted through openings formed for terminal insertion into receptacle housing (42) in the rear portion (54) of the receptacle housing (42) and retained in the receptacle housing (42) by a resilient spring finger (66). Corresponding openings (68) of FIG. 5 that are aligned with the terminal passages (60) are formed in the mating or front portion (52) of the receptacle housing (42) for receiving contact portions (7) of second electrically conductive terminals (2) retained in the second plug connector (70) therethrough for electrical engagement with the first electrically conductive terminals (12).

Figure 3:
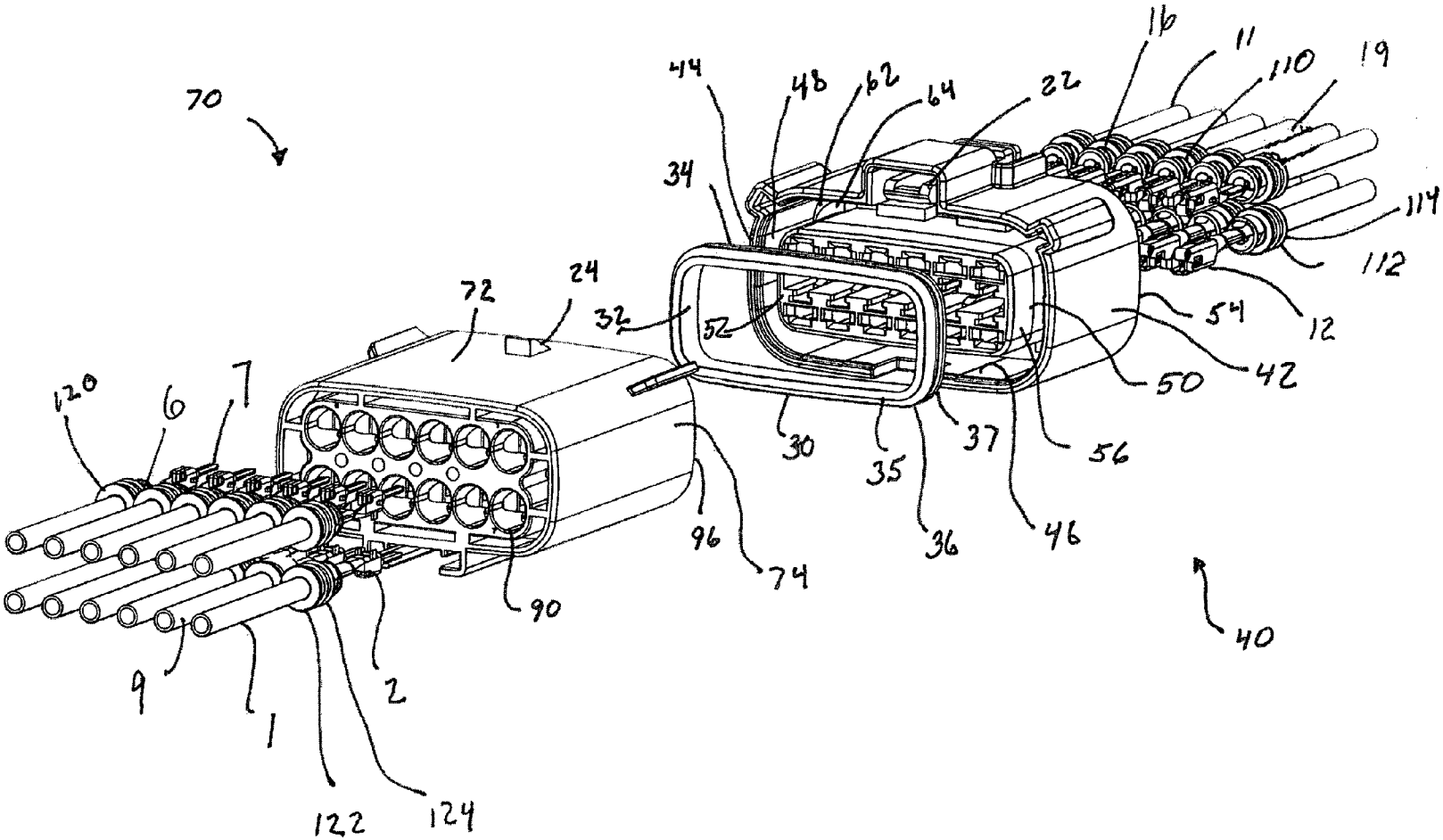
FIG. 3 is an exploded perspective view of the connector system of FIG. 1 looking into the receptacle connector.
Figure 5:
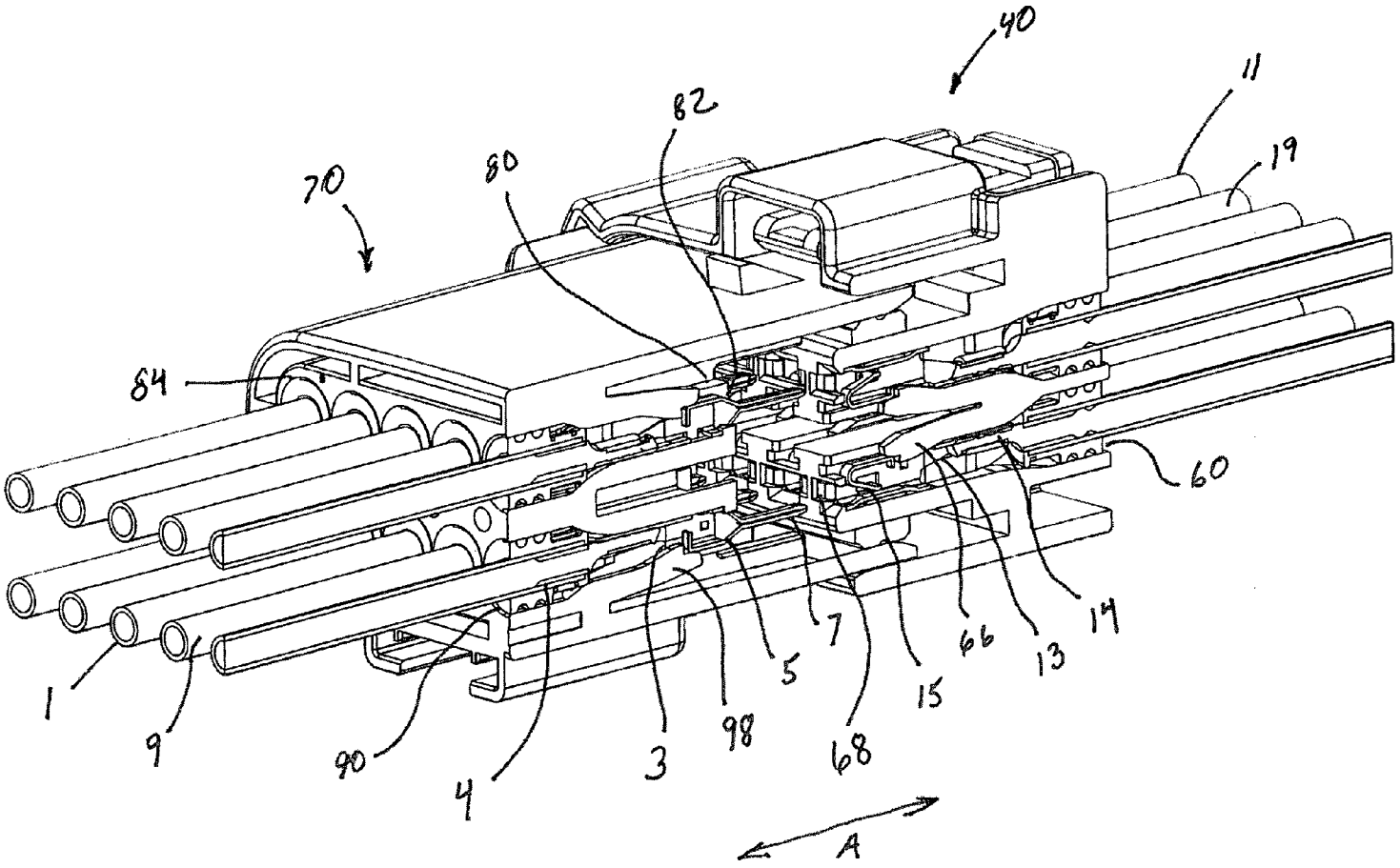
FIG. 5 is a cross sectional view of the connector system of FIG. 1 at the beginning of the mating sequence.

As best shown in FIGS. 3 and 5 each first electrically conductive terminal (12) is stamped and formed from an electrically conductive material such as copper or copper based alloy or such other similar conducting material. The terminals have a main body portion (13) with a wire receiving portion (14) formed at one end of the main body portion (13) and a mating end (15) extending from a second end of the main body portion (13) for electrical contact with a respective mating the second electrically conductive terminal (2). The wire receiving portion (14) has a crimp portion (16) for securing a lead wire (19) to the wire receiving end (14) of the first electrically conductive terminal (12) with the lead wire (19) extending rearward from the receptacle connector (40). In certain applications that require resistance to liquid and or moisture and debris infiltration, a wire seal (110) is secured to the wire (19) through crimp portion (16) and also received in the passage (60). Typically the wire seal (110) surrounds the lead wire (19) and has a securing portion that is also secured to the crimp portion (16) of the wire receiving portion (14) of the electrical terminal (12). A sealing portion (112) extends from the securing portion of the seal (110) and includes an enlarged outer diameter with annual sealing lips (114) for maintaining tight registration with the interior surface wall of each respective passage (60) preventing the ingress of liquid and or moisture and debris through the rear portion of the receptacle connector (40).

A shroud or hood (44) surrounds a periphery of the main body portion (50) of the receptacle housing (42) and forms an opening or receiving space (48) between an exterior surface (56) of the main body portion (50) of the receptacle housing (42) and an interior surface (46) of the shroud (44). The hood (44) is joined to the main body (50) portion at the terminal receiving portion (54) of the receptacle connector housing (42). The receiving space (48) formed between the main body portion (50) and the shroud or hood (44) accommodates a hood extension (74) formed in the second plug connector (70) that upon mating creates an overlap to provide protection of the mating interface from damage. Similarly, the receiving space (48) also provides an opening for receiving an elastomeric perimeter seal (30) for the prevention of liquid and or moisture entering the connector system (10).

A bridging portion or rib (62) is integrally formed in the receiving space (48) and connects the main body portion (50) of the receptacle housing (42) with the hood or shroud (44). The plurality of the bridging portion (62) may be equally spaced in the receptacle connector (40). In another embodiment, any number of bridging portions (62) can be formed along the perimeter of the main body portion (50) of the receptacle housing (42), depending on the size of the receptacle connector (40). The connector having a greater number of electrical contacts resulting to a larger housing size would require more bridging portion(s) (62) formed in the space around the periphery of the main body portion (50). In the present embodiment, the bridging portions (62) are located at respective corners of the receptacle connector (40). The bridging portions or ribs (62) improves the manufacturabilty of the receptacle housing (42) by improving the molding process and adding stiffness to improve the connector's resistance to vibration and shock. The bridging portion (62) includes a surface or front face (64) that is normal to the mating direction of the connector system (10). The front face (64) is positioned rearward of the receptacle mating face (52) and forward of the terminal receiving (54) portion of the receptacle connector housing (42) at a point where the shroud (44) is joined to the connector housing (42). In other embodiment, the front face (64) of the bridging portion (62) acts as the stopper to the peripheral seal (30).

The perimeter seal (30) is molded from a pliable elastomeric material that is conformable to any shape that it surrounds. The perimeter seal (30) has a cross section with a flat interior surface (32) that engages the outer or exterior surface (56) of the main body portion (50) of the receptacle connector housing (42) and completely surrounds the body portion (50). Opposite the interior flat surface (32) side of the seal is a contoured exterior surface (34). Typically this surface includes one or more sealing lips (36), which are formed as projections that follow the perimeter of the perimeter seal (30). The sealing lips (36) engage the interior surface (76) of the shroud or hood extension (74) of the mating plug connector (70). The sealing lips (36) have a particular cross section that allow the sealing lips (36) to displace and resiliently compress along the interior surface (76) of the plug connector (70) and still maintain a substantial amount of rigidity to provide a tight registration with the interior surface (76), maintaining a waterproof barrier between the receptacle connector (40) and the plug connector (70).

The perimeter seal (30) has a predefined width that extends in a direction along the mating axis (A) of the connector system (10) with a front surface (35) and rear surface (37) that is typically perpendicular or normal to the mating direction (A). The front surface (35) of the perimeter seal (30) has a flat front face surface that is generally parallel to the mating surface (52) of the plug connector housing (42). During assembly, the perimeter seal (30) is placed on and around the main body portion (50) of the receptacle housing (42) and pressed or slid along the mating direction (A) of the connector system (10). The rear surface (37) of the seal has a flat surface spaced apart from the front surface of the seal in a direction along the mating axis (A) of the connector system (10), and upon assembly to the receptacle connector (40) and the plug connector (70), the rear face (37) of the seal abuts each respective front face (64) of the bridging portions (62) in the intervening or receiving space (48) between the hood (44) and main body portion (50) of the receptacle housing (42).

The second or plug connector (70) is similarly molded from an insulative material and is configured to mate or receive the first or receptacle connector (40) therein. The second connector (70) includes a main body portion (80), a front or mating portion (82) extending from one side of the main body portion (80) and a rear or terminal receiving portion (84) extending from an opposite side of the main body portion (80). The main body portion (80) includes a plurality of cavities or passages (90) formed therein for receiving a plurality of second electrically conductive terminals (2). The terminals are inserted through openings formed in the rear portion (84) of the receptacle connector housing (72) and similarly retained in the housing (72) by a resilient spring finger (98). The second electrically conductive terminals (2) are aligned with respective first conductive terminals (12) of the receptacle connector (40) and, upon mating, make full electrical connection with the first electrically conductive terminals (12) of the receptacle connector (10).

Each second electrically conductive terminal (2) is stamped and formed from an electrically conductive material such as copper or copper based alloy or such other conductive alloy/metal. The second electrically conductive terminals (2) have a main body portion (3) with a wire receiving portion (4) formed at one end of the main body portion (3) and a mating end (5) extending from a second end of the main body portion (3). The wire receiving portion (4) has a crimp portion (6) for securing a lead wire (9) and a wire seal (120) to the wire receiving portion (4) of the second electrically conductive terminal (2) with the lead wire (9) extending rearwardly from the plug connector (70). Similarly, in applications that require resistance to liquid and or moisture and debris infiltration, the wire seal (120) is secured to the wire (9) and also received in the passage (90). The wire seal (120) surrounds the lead wire (9) and has a securing portion that is also secured to the crimp portion (6) of the wire receiving portion (4) of the second electrically conductive terminal (2). A sealing portion (122) extends form the securing portion of the wire seal (120) and includes an enlarged outer diameter with annual sealing lips (124) for maintaining tight registration with the interior surface wall of each respective passageway (90) preventing liquid and or moisture and debris from entering the rear portion of the plug connector (70).

Extending from the main body portion (3) of each second electrically conductive terminal (2) is an elongated blade contacting portion (7). The elongated blade contacting portion (7) protrudes through the front mating portion (82) of the plug housing (72) and extends beyond the mating face (82) a predetermined distance wherein, upon complete mating of the connector system (10), the elongated blade contacting portion (7) extend through the mating portion (52) of the first receptacle housing (42) and electrically engage the contact portions of the first electrically conductive terminals (12).

Figure 4:
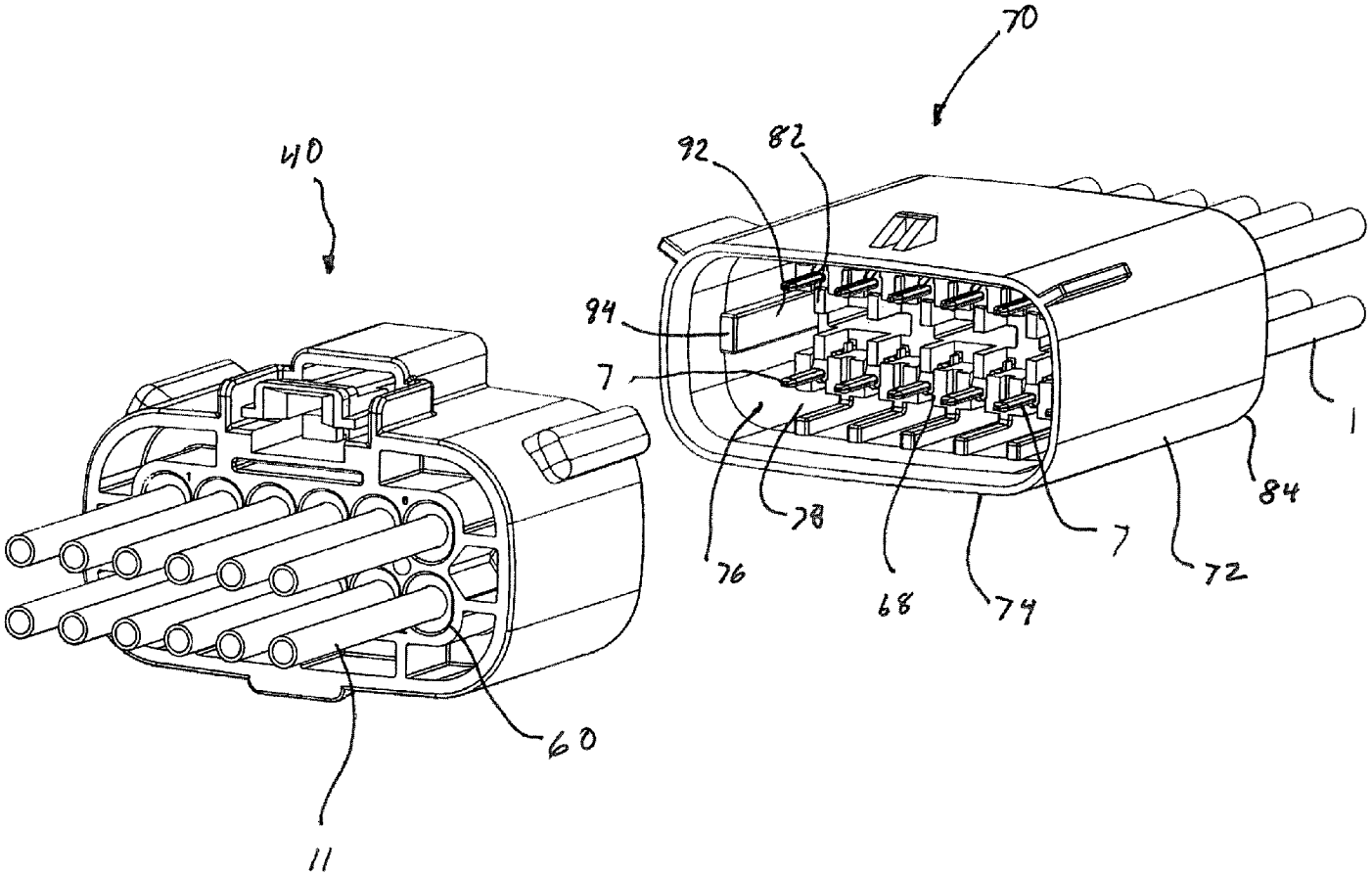
FIG. 4 is an exploded perspective view of the connector system of FIG. 1 looking into the plug connector.

As best shown in FIG. 4 the shroud or hood extension (74) surrounds a periphery of the main body portion (80) of the second connector housing/plug housing (72) and forms a second opening or space (78) between the exterior surface (86) of the main body portion (80) of the second connector housing (72) and an interior surface (76) of the hood extension (74). The hood extension (74) is joined to the main body portion (80) at the rear or terminal receiving portion (84) of the plug housing (72) and extends beyond the front mating portion (82) of the plug housing (72), whereby the hood extension (74) is positioned within the receiving space (48) of the receptacle connector (40) upon mating of the connector system (10). The hood extension (74) of the plug housing (72) has an inner surface (76) that conforms to the same profile of the perimeter of the main body portion (50) of the receptacle housing (42).

As best shown in FIG. 4 a second bridging portion or rib (92) is integrally formed in the space (78) between the main body portion (80) and the hood extension (74) of the plug housing (72) and connects the main body portion (80) and the hood extension (74) together. The second bridging portion (92) has a base positioned at the junction of the main body portion (80) and the hood extension (74) and extends in a mating or forward direction (A). In this embodiment the plug connector (70) is formed with plurality of equally spaced second bridging portions (92). In another embodiment, the number of second bridging portions (92) may be formed depending on the size of the plug connector (70). Generally, the bridging portions or ribs (62, 92) are present on both the receptacle connector (40) and plug connector (70) but number and any combination of bridging portions (62, 92) may be used depending on the structure and spacing requirements.

The arrangement and number of the bridging portions (62, 92) can be adjusted to meet any structural requirements. Similarly, as described above with respect to the receptacle connector (40), the second bridging portions or ribs (92) improve the manufacturabilty of the plug housing (72) and add stiffness to improve the connector's resistance to vibration and shock especially when the receptacle connector (40) and plug connector (70) are connected together. The second bridging portion (92) includes a surface or front face (94) that is normal to the mating direction (A) of the connector system (10). The front face (94) of the second bridging portion (92) is positioned forward of the receptacle mating face (82) and rearward of the front or leading edge (96) of the hood extension (74).

The bridging portions (62, 92) are preferably formed along the periphery of the main body portion (50, 80) of each connector (40, 70) and in general, the number and spacing of the bridging portions (62, 92) are determined by the circuit size of the connector system (10). In the preferred embodiment, the plurality of the equally space bridging portions (62, 92) on both the receptacle connector (40) and plug connector (70). Upon mating of the connectors, the bridging portions (62) of the receptacle connector (40) are axially aligned with the spaces between the second bridging portions (92) of the plug connector (70). Alternatively, in certain instances the bridging portions (62, 92) on both the receptacle connector (40) and plug connector (70) may also be axially aligned or in any specific orientation depending on the specific application.

It can be appreciated that the size and shape of the bridging portions (62, 92) can vary also. In the present embodiment, the bridging portions (62, 92) are shown as generally rectangular having a specific width, height and length with each dimension being able to be controlled independently. There can also be bridging portions having various cross-sections such as triangular, trapezoidal and cylindrical and any variation or combination of the above. These shapes and sizes of the bridging portions are directly related to the specific use and environment of the application. For instance high shock and vibration would indicate a need for possibly larger structures and bridging portions of various spacing and location.

Additionally, the bridging portions (62, 92) also directly affect the manfacturabily of the connector housings (42, 72). The geometry of the bridging portions (62, 92), especially the size, shape and location affect the stiffness and other structural characteristics of the connector housings (42, 72) as well. In particular, specific to under-hood applications involving high temperatures the bridging portions can be tailored to add rigidity and minimize warping and differential shrink that may be introduced during the molding process integrity of the connector housings (42, 72).

As an additional benefit, the bridging portions (62, 92) create a series of obstructions within the internal receiving spaces of each connector housing (42, 72). These obstructions create a barrier that prevents any objects from entering into the connector housings and potentially damaging the electrically conductive terminals. Additionally, during the mating of the plug connector (70) and receptacle connector (40) the bridging portions (62, 92) provide scoop proofing, in other words, the bridging portions (62, 92) prevent the edges or corners of the connectors, while being mated to stub against any terminals (2, 12) within the receiving spaces, instead the respective corners or edges of the connector housings (42, 72) will abut the bridging portions (62, 92) rather than the electrical terminals (2, 12).

Figure 6:
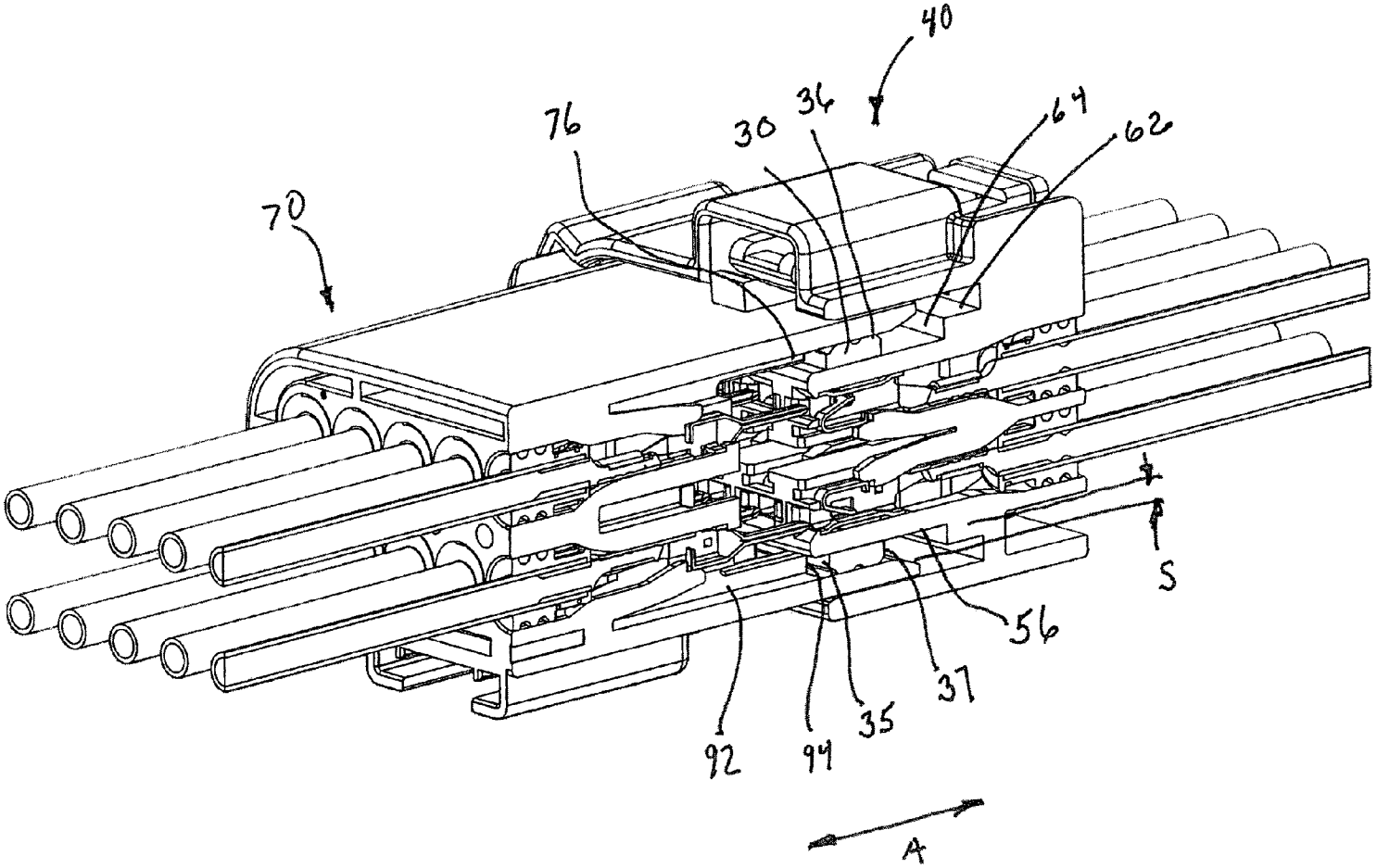
FIG. 6 is a cross sectional view of the connector system of FIG. 1 at an intermediate position of the mating sequence.
Figure 7:
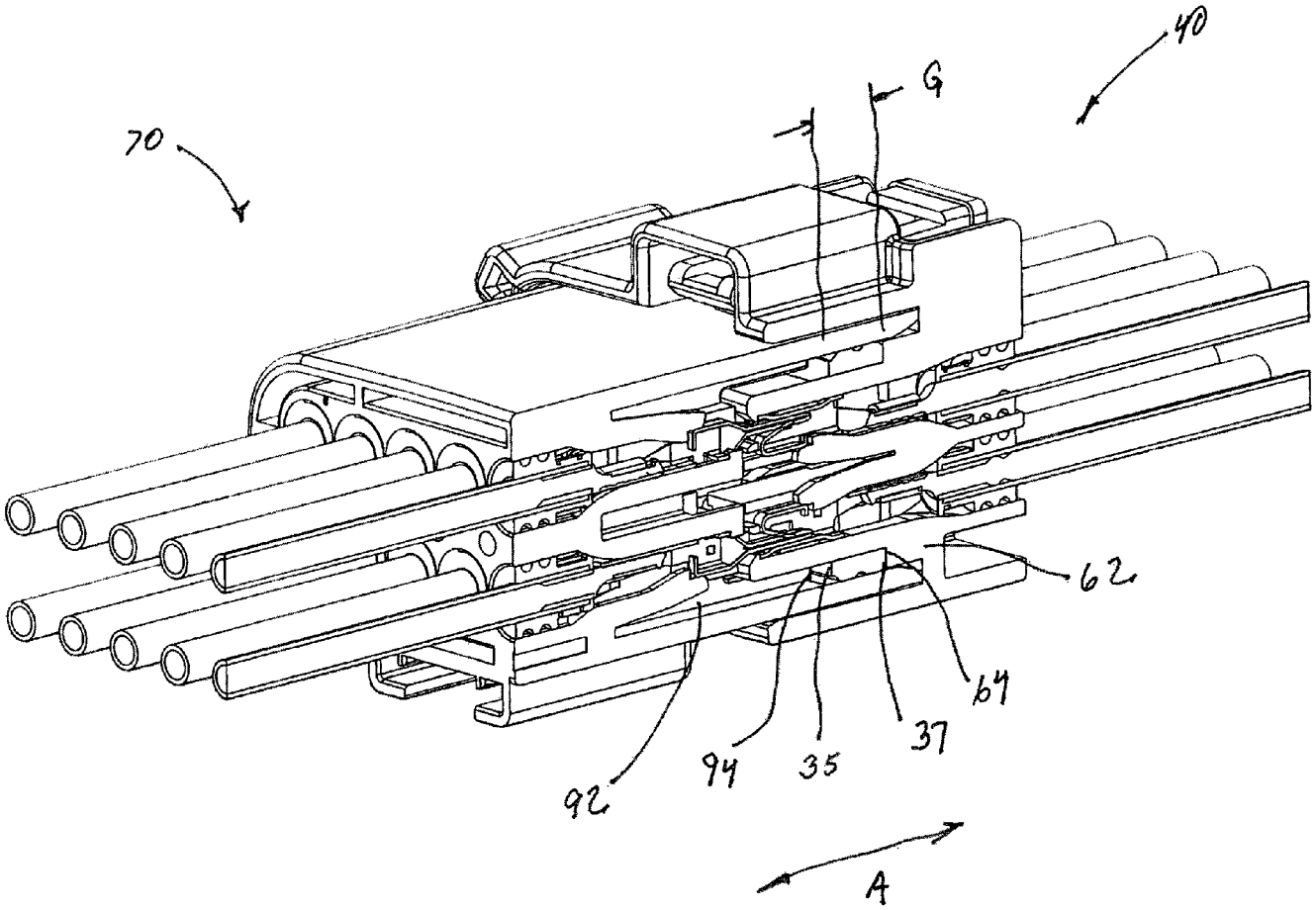
FIG. 7 is a cross sectional view of the connector system of FIG. 1 at the end of the mating sequence.

With the construction described in this embodiment as shown in FIGS. 5-7, a space (S) exists between the exterior surface (56) of the main body portion (50) of the receptacle housing (42) and the inner surface (76) of the hood extension (74) of the plug housing (72). The space (S) is appropriately dimensioned so as to provide an area to allow the perimeter seal (30) to be positioned between the exterior surface (56) of the main body portion (50) of the receptacle housing (42) and the inner surface (76) of the hood extension (74) of plug housing (72). Upon mating of the receptacle connector (40) and plug connector (70), while the plug-side hood extension (74) is being inserted into the receiving space (48) of the receptacle connector (40), the plug-side hood extension (74) compresses the sealing lips (36) formed on the perimeter seal (30) and elastically deforms the sealing lips (36) so as to be closely abutted against the inner surface (76) of the plug-side hood extension (74), creating a waterproof barrier between the receptacle connector (40) and plug connector (70) as best illustrated in FIG. 7.

Therefore, when connecting the receptacle connector (40) and the plug connector (70) to each other, the front surface or face (94) of the second bridging portion (92) of the plug connector (70) engages a front edge (35) of the perimeter seal (30) and, upon further insertion, guides the perimeter seal (30) along the body portion (50) of the receptacle housing (42) in a mating direction (A) to a position where the rear surface (37) of the perimeter seal (30) engages the front surface (64) of the first bridging portion (62) on the receptacle connector (40). The engagement and seating action of the second bridging portion (92) of the plug connector (70) further guides and aligns the perimeter seal (30) so that it is in a proper position to provide a waterproof connection.

Of course, it is contemplated that within the spirit of the present invention, a waterproof connection may not always be required. In such applications, the seal is not used in the connector system (10). In this instance, the perimeter seal (30) is simply not included in the present connector system (10) and no other modification to the connector system (10) is required. A gap (G) remains between the front surface (64) of the first bridging portion (62) of the receptacle connector (40) and front surface (94) of the second bridging portion (92) of the plug connector (70). In this instance the bridging portions (62, 92) function as stiffeners that add support to the connector system (10).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector system comprising:

a receptacle connector having a receptacle housing, the receptacle housing having a body portion including a first end and a second end, the body portion having a plurality of passages for receiving at least one conductive terminal through openings along a mating direction in the second end therein;

a lateral wall surrounding the body portion;

a space between the lateral wall and the body portion;

at least one bridging portion connecting the body portion to the lateral wall, the bridging portion including an end surface positioned normal to the mating direction;

a plug connector having a plug housing, the plug housing having a body portion, a first end and a second end, the body portion having a plurality of second passages for receiving at least one second conductive terminal through openings along the mating direction in the second end therein and the at least one second conductive terminals being mateable with the at least one conductive terminals of the receptacle connector;

a shroud surrounding the body portion of the plug housing;

a space between the body portion and the shroud of the plug housing;

at least one bridging portion connecting the body portion to the shroud of the plug housing, the bridging portion including an end surface positioned normal to the mating direction;

an elastomeric seal is disposed on the body portion of the receptacle housing in an intervening gap defined between the end surface of the bridging portion of the receptacle housing and the end surface of the bridging portion of the plug housing when the receptacle connector and the plug connector are mated together; and wherein the end surface of the bridging portion of the plug housing abuts the seal.

2. The connector system of claim 1, wherein the receptacle housing and the plug housing are formed from an insulative material.

3. The connector system of claim 1, wherein the bridging portions formed on the receptacle housing have a rectangular cross-section.

4. The connector system of claim 1, wherein the bridging portions formed on the plug housing have a rectangular cross-section.

5. The connector system of claim 1, wherein there are an equal number of bridging portions formed on the receptacle housing and the plug housing.

6. The connector system of claim 5, wherein the bridging portions formed on the receptacle housing are equally spaced around the body portion of the receptacle housing and the bridging portions formed on the plug housing are equally spaced around the body portion of the plug housing.

7. The connector system of claim 6, wherein the bridging portions formed on the receptacle housing are axially offset from the bridging portions formed on the plug housing when the plug connector and the receptacle connector are mated together.

8. A connector system comprising:

a receptacle connector having a receptacle housing, the receptacle housing having a body portion including a first end and a second end, the body portion having a plurality of passages for receiving at least one conductive terminal through openings in the second end therein, a lateral wall surrounding the body portion and at least one bridging portion connecting the body portion to the lateral wall, the bridging portion including an end surface;

a plug connector having a plug housing, the plug housing having a body portion, a first end and a second end, the body portion having a plurality of second passages for receiving at least one of second conductive terminals through openings in the second end therein and the at least one of second conductive terminals being mateable with the at least one of the conductive terminals of the first connector, the second connector including a shroud surrounding the body portion and a bridging portion connecting the body portion to the shroud, the bridging portion including an end surface; and an elastomeric seal positioned on the body portion of the receptacle housing, the elastomeric seal having a first edge and a second edge, wherein the first edge engages the end surface of the bridging portion of the receptacle housing and the second edge engages the end surface of the bridging portion of the plug housing when the receptacle connector and the plug connector are mated together.

9. The connector system of claim 8, wherein the receptacle housing and the plug housing are formed from an insulative material.

10. The connector system of claim 8, wherein the bridging portions formed on the receptacle housing have a rectangular cross-section.

11. The connector system of claim 8, wherein the bridging portions formed on the plug housing have a rectangular cross-section.

12. The connector system of claim 8, wherein there are an equal number of bridging portions formed on the receptacle housing and the plug housing.

13. The connector system of claim 11, wherein the bridging portions formed on the receptacle housing are equally spaced around the body portion of the receptacle housing and the bridging portions formed on the plug housing are equally spaced around the body portion of the plug housing.

14. The connector system of claim 12 wherein the bridging portions formed on the receptacle housing are axially offset from the bridging portions formed on the plug housing when the plug connector and the receptacle connector are mated together.

15. A connector system comprising:

a receptacle connector having a receptacle housing, the receptacle housing having a body portion including a first end and a second end, the body portion having a plurality of passages for receiving at least one conductive terminal through openings in the second end therein, a lateral wall surrounding the body portion and at least one bridging portion connecting the body portion to the lateral wall, the bridging portion including an end surface;

a plug connector having a plug housing, the plug housing having a body portion, a first end and a second end, the body portion having a plurality of second passages for receiving at least one of second conductive terminals through openings in the second end therein and the at least one of second conductive terminals being mateable with the at least one of the conductive terminals of the receptacle connector, the plug housing including a shroud surrounding the body portion and a bridging portion connecting the body portion to the shroud, the bridging portion including an end surface;

an elastomeric seal positioned on the body portion of the receptacle housing, the elastomeric seal having a first edge and a second edge, wherein the first edge engages the end surface of the bridging portion of the receptacle housing and the second edge engages the end surface of the bridging portion of the plug housing; and wherein the end surface of the bridging portion of the plug housing engages the second edge of the elastomeric seal and advances the elastomeric seal during mating of the receptacle connector and the plug connector.

* * * * *